US011058911B2

(12) United States Patent
Pensivy

(10) Patent No.: US 11,058,911 B2
(45) Date of Patent: Jul. 13, 2021

(54) ANKLE AND FOOT THERAPY DEVICE AND METHOD

(71) Applicant: Scott Pensivy Physical Therapy, Ltd., Las Vegas, NV (US)

(72) Inventor: Scott Pensivy, Las Vegas, NV (US)

( * ) Notice: Subject to any disclaimer, the term of this patent is extended or adjusted under 35 U.S.C. 154(b) by 54 days.

(21) Appl. No.: 16/369,569

(22) Filed: Mar. 29, 2019

(65) Prior Publication Data

US 2019/0299048 A1 Oct. 3, 2019

Related U.S. Application Data

(60) Provisional application No. 62/650,019, filed on Mar. 29, 2018.

(51) Int. Cl.

| | |
|---|---|
| ***A63B 21/00*** | (2006.01) |
| ***A63B 23/08*** | (2006.01) |
| ***A63B 21/04*** | (2006.01) |
| ***A63B 21/055*** | (2006.01) |
| ***A63B 23/10*** | (2006.01) |

(52) U.S. Cl.

CPC .... *A63B 21/4034* (2015.10); *A63B 21/00061* (2013.01); *A63B 21/00069* (2013.01); *A63B 21/0442* (2013.01); *A63B 21/0557* (2013.01); *A63B 23/08* (2013.01); *A63B 23/10* (2013.01); *A63B 2225/093* (2013.01)

(58) Field of Classification Search

CPC ..... A63B 21/4034; A63B 21/075; A63B 21/0557; A63B 21/02; A63B 21/00061; A63B 21/00069; A63B 21/0442; A63B 23/08; A63B 23/10; A63B 2225/093; A61H 1/0266; A61H 2001/027

USPC ..... 602/22

See application file for complete search history.

(56) References Cited

U.S. PATENT DOCUMENTS

| | | | | |
|---|---|---|---|---|
| 2,760,774 | A | 8/1956 | Perez | |
| 4,869,499 | A | 9/1989 | Schiraldo | |
| 5,010,878 | A * | 4/1991 | Kline | A63B 23/10 601/27 |
| 5,039,093 | A | 8/1991 | Collier | |
| 5,100,129 | A | 3/1992 | Porter et al. | |
| 5,186,698 | A | 2/1993 | Mason et al. | |
| 5,593,374 | A | 1/1997 | Gvoich | |
| 5,702,354 | A | 12/1997 | DeSpain et al. | |
| 6,063,013 | A | 5/2000 | Vathappallil | |
| 6,077,203 | A | 6/2000 | Lay | |
| 6,283,897 | B1 | 9/2001 | Patton | |
| 6,942,604 | B2 | 9/2005 | Teff | |
| 7,322,914 | B1 | 1/2008 | Vittone et al. | |
| 8,202,205 | B2 | 6/2012 | Reade | |
| 8,343,014 | B2 | 1/2013 | Findeisen | |
| 8,360,940 | B2 | 1/2013 | Kole et al. | |
| 8,403,817 | B2 | 3/2013 | Ferguson et al. | |
| 8,529,412 | B2 | 9/2013 | Reade | |
| 8,876,670 | B2 | 11/2014 | Reade | |

(Continued)

*Primary Examiner* — Nyca T Nguyen
*Assistant Examiner* — Andrew M Kobylarz
(74) *Attorney, Agent, or Firm* — Weide & Miller, Ltd.

(57) ABSTRACT

An ankle and foot therapy and strengthening device includes a base having a top surface with a groove configured to receive and support a lower leg of a user; band adjustment and locking devices mounted to the base; and one or more resistance bands configured to be locked into the band adjustment and locking devices, the resistance bands comprising a toe engaging device attached thereto.

19 Claims, 9 Drawing Sheets

(56) References Cited

U.S. PATENT DOCUMENTS

| | | | | |
|---|---|---|---|---|
| 9,132,308 | B2 | 9/2015 | Kole et al. | |
| 9,138,616 | B2 | 9/2015 | Ferri | |
| 9,387,359 | B2 | 7/2016 | Ferri | |
| 9,561,395 | B2 | 2/2017 | Rogoff | |
| 9,651,395 | B2 | 2/2017 | Rogoff | |
| 10,286,247 | B2 * | 5/2019 | Marquez | A63B 21/4009 |
| 2005/0113221 | A1 | 5/2005 | Dovner et al. | |
| 2013/0072326 | A1 * | 3/2013 | Pugliese | A63B 69/0086 473/425 |
| 2014/0057758 | A1 | 2/2014 | Mack | |
| 2014/0187388 | A1 * | 7/2014 | Rogoff | A63B 21/0442 482/79 |
| 2015/0258367 | A1 | 9/2015 | Tayebi et al. | |
| 2016/0089576 | A1 * | 3/2016 | Rosenstiel | A63B 21/055 482/146 |
| 2016/0339296 | A1 * | 11/2016 | Barel | A63B 21/4034 |

* cited by examiner

ANKLE AND FOOT THERAPY DEVICE AND METHOD

CROSS REFERENCE TO RELATED APPLICATION

This application claims priority to U.S. Provisional Application Ser. No. 62/650,019, filed Mar. 29, 2018, which application is incorporated by reference herein in its entirety.

BACKGROUND

The disclosed embodiments relate to physical therapy and strengthening devices. More specifically, the disclosed embodiments relate to an ankle and foot therapy or strengthening device including an ankle platform for open kinetic and closed kinetic strengthening and methods for utilizing the same.

Maintaining adequate ankle strength or receiving effective rehabilitation treatment for ankle injuries is important to both amateur and professional athletes alike. Twenty-five percent of orthopedic doctor visits are related to foot and ankle pain. It also may be important for some to simply maintain or regain a healthy and active life style. While exercise and physical therapy equipment is common for large muscle groups, there are fewer options for equipment that strengthen the many intrinsic and extrinsic muscle groups that articulate the foot about the ankle. This is also true for strengthening and rehabilitation for similar muscles about a wrist.

Some devices that are available for strengthening the ankles are large, cumbersome, and often ineffective. Many ankle strengthening devices include a harness or similar device to connect the device to the foot in order to strengthen the ankle. However, these harnesses are prone to slipping and migration when resistance is applied, thus reducing the comfort, safety, and effectiveness of the devices. The ankle and foot have small ranges of motion so any missed range of motion (ROM) from the slippage often seen with straps to secure the resistance is less effective to receive a desired outcome.

SUMMARY

Given the above, aspects of the disclosure provide a device/platform that provides strengthening exercises for an ankle or wrist to improve the range of motion and strengthen proprioception challenges effectively, efficiently, and safely. The disclosed embodiments provide a platform to conduct multiple different strengthening exercises designed to improve range of motion, strength, speed, coordination, proprioception, and kinesthetic awareness in a non-weight-bearing position. The device/platform further may include a cushion or pillow to stand on to help with improving balance and proprioception to assist in the over strength of the foot and ankle in a closed kinetic chain activity.

The disclosed embodiments have been developed in light of the above, and aspects of the disclosure may include an ankle and foot therapy and strengthening device comprising a base having a top surface with a groove configured to receive and support a lower leg of a user; band adjustment and locking devices; and one or more resistance bands configured to be locked into the band adjustment and locking devices, the resistance bands comprising a toe engaging device on one end thereof. The resistance bands may comprises an elastic band, tubing, an elongated elastic sheet, or the like.

In some embodiments, the toe engaging device is a resilient ball. This soft ball and rubber tubing between the toes allow for a secure anchor so resistance can be applied appropriately. In some examples, the base comprises a raised platform, and the groove is formed on the raised platform. At least one of the band adjustment and locking devices may be disposed on the raised platform.

In other embodiments, the ankle and foot therapy and strengthening device may further comprise a strap mounted on each side of the groove. This helps to stabilize the leg and isolate the ankle during use. Further, a frame may be provided having legs with casters mounted on the end of the legs. The base may be mounted onto the frame, and the frame may be height adjustable and the wheels may be able to be locked to allow a secure base.

The ankle and foot therapy and strengthening device may also comprise a band storage device corresponding to each of the band adjustment and locking devices. The band storage device may be configured to store at least a portion of one of the resistance bands that is on one side of the corresponding band adjustment and locking device. This device may be a cleat-like component around which excess tubing is wrapped. A resilient balance pad may be disposed on the top surface between the band adjustment and locking devices. This allows balancing exercises to be done using the same device.

According to other aspects of the disclosure, an exercise device comprises an elastic band or tubing having a first end and a second end, and a resilient ball mounted to said tubing between said first and second ends thereof. The resilient ball may have a diameter between 20 mm and 80 mm, or more specifically between 35 mm and 50 mm. One ideal size for the resilient ball may be about the size of a golf ball, or a ball having a diameter of about 42 mm. The resilient ball may be mounted to the tubing proximate to one of the first and second ends.

According to other aspects of the disclosure, a therapy and strengthening device comprises a base having a top surface configured to receive and support a limb of a user, band adjustment and locking devices mounted to the base, and one or more resistance bands configured to be locked into the band adjustment and locking devices. The resistance bands may include a digit engaging device attached thereto to allow the user to grip the resistance band with the user's fingers or toes via the digit engaging device.

In some embodiments, the digit engaging device is a resilient ball. The base may comprise a raised platform, and a groove may be formed on the raised platform to receive the limb of the user. At least one of the band adjustment and locking devices may be disposed on the raised platform.

In further embodiments, a strap may be mounted on each side of the groove. The base may be mounted to a frame having legs with casters mounted on the end of the legs. The frame may be height adjustable.

Further objects, features, and advantages of the present invention over the prior art will become apparent from the detailed description of the drawings which follows, when considered with the attached figures.

DETAILED DESCRIPTION OF EMBODIMENTS

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Figure 1:
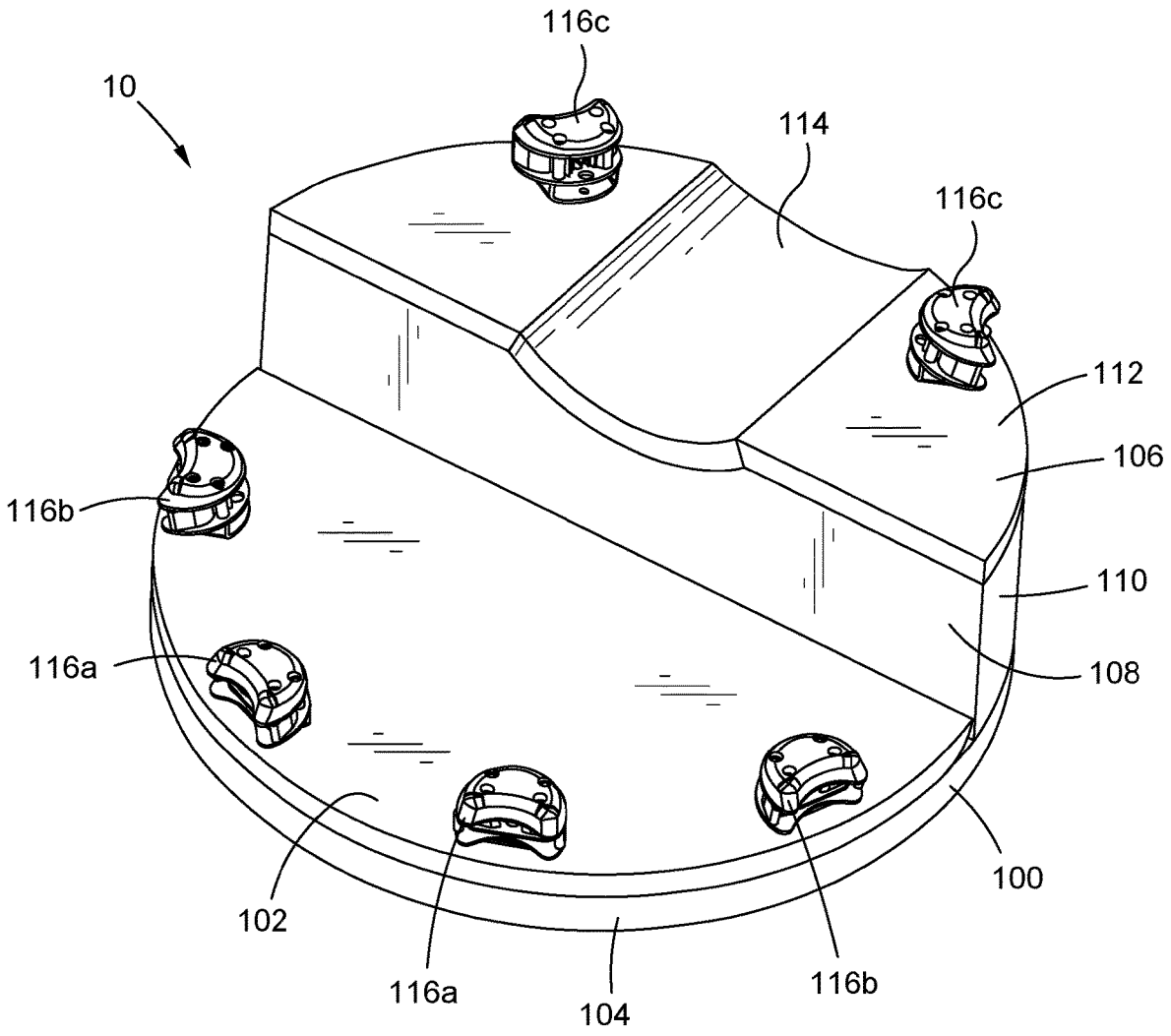
FIG. 1 is a top perspective view of an ankle and foot therapy and strengthening device, according to one exemplary embodiment.

FIG. 1 is a top perspective view of an ankle and foot therapy and strengthening device, according to one exemplary embodiment. The invention is referred to herein as an ankle and foot therapy and strengthening device because that is a preferred primary use for the device. However, as noted below, aspects of the invention may be used for other purposes, such as for wrist therapy and strengthening.

In FIG. 1, an ankle and foot therapy and strengthening device 10 comprises a base 100. The base 100 is formed in a cylindrical shape in this embodiment, though other shapes may also be used. The base includes an upper surface 102 and an annular side wall 104. A raised platform 106 is formed integrally with the base 100 or is attached thereto. The raised platform 106 is a projected semi-circle or half cylinder with a flat, front sidewall 108 and a semi-circular rear sidewall 110. A top surface 112 of the raised platform 106 comprises a groove 114 that is configured to receive and support a lower leg of a user of the ankle and foot therapy and strengthening device 10.

The ankle and foot therapy and strengthening device 10 may be formed from a durable plastic material to provide adequate strength while remaining relatively light weight. The base 100 and platform 106 may be formed separately or integrally. The base 100 and platform 106 may be formed using any suitable manufacturing process such as injection molding. Of course, other natural or synthetic materials may be used to construct the ankle and foot therapy and strengthening device 10, as are now known or will be later developed. One or both of the top surface 102 of the base and the top surface 112 of the platform 106 may include a resilient or cushioned material that is attached to the surface 102 and 112. This increases a comfort of the user when working with the ankle and foot therapy and strengthening device 10.

The ankle and foot therapy and strengthening device 10 includes a plurality of band adjustment and locking devices 116. Specifically, there are two forward band adjustment and locking devices 116*a*, two lateral band adjustment and locking devices 116*b*, and two rear band adjustment and locking devices 116*c*. Each pair of band adjustment and locking devices 116*a*, 116*b*, 116*c* are disposed on the top surface 102 or platform top surface 112 at equal distances and angles on either side of the groove 114. The placement of the devices 116*a*, 116*b*, and 166*c* addresses each plane of movement: frontal, sagittal, and transverse. The band adjustment and locking devices 116 facilitate therapy and strengthening exercises using fitness bands as will be explained in more detail below.

Figure 2:
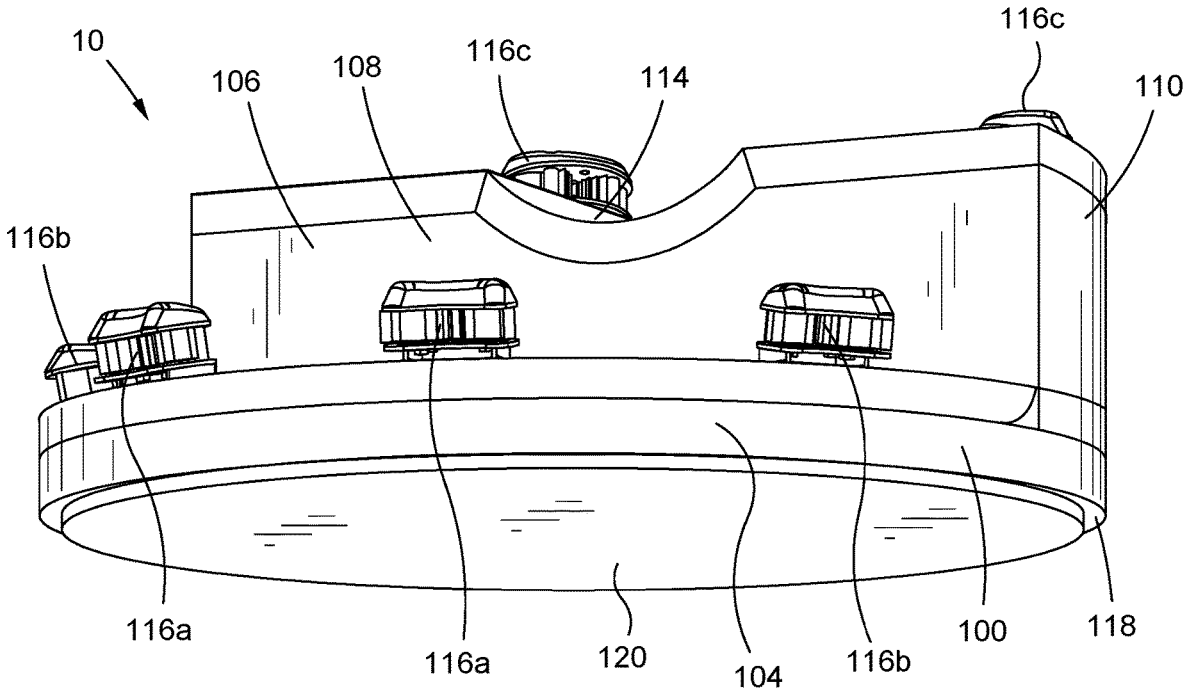
FIG. 2 is a bottom perspective view of the ankle and foot therapy and strengthening device shown in FIG. 1.

FIG. 2 is a bottom perspective view of the ankle and foot therapy and strengthening device shown in FIG. 1. As shown in FIG. 2, the ankle and foot therapy and strengthening device 10 includes a bottom surface 118. A friction enhancing surface or material 120 may be attached to the bottom surface 118, such as via an adhesive, by spraying, or by other application, or the bottom surface 118 may be formed to include such a feature, so as to prevent the ankle and foot therapy and strengthening device 10 from moving or sliding as it rests on a surface, such as a floor or table. The friction enhancing surface may be a natural or synthetic rubber material, or any other known material which has a high coefficient of friction against a supporting surface.

Figure 3:
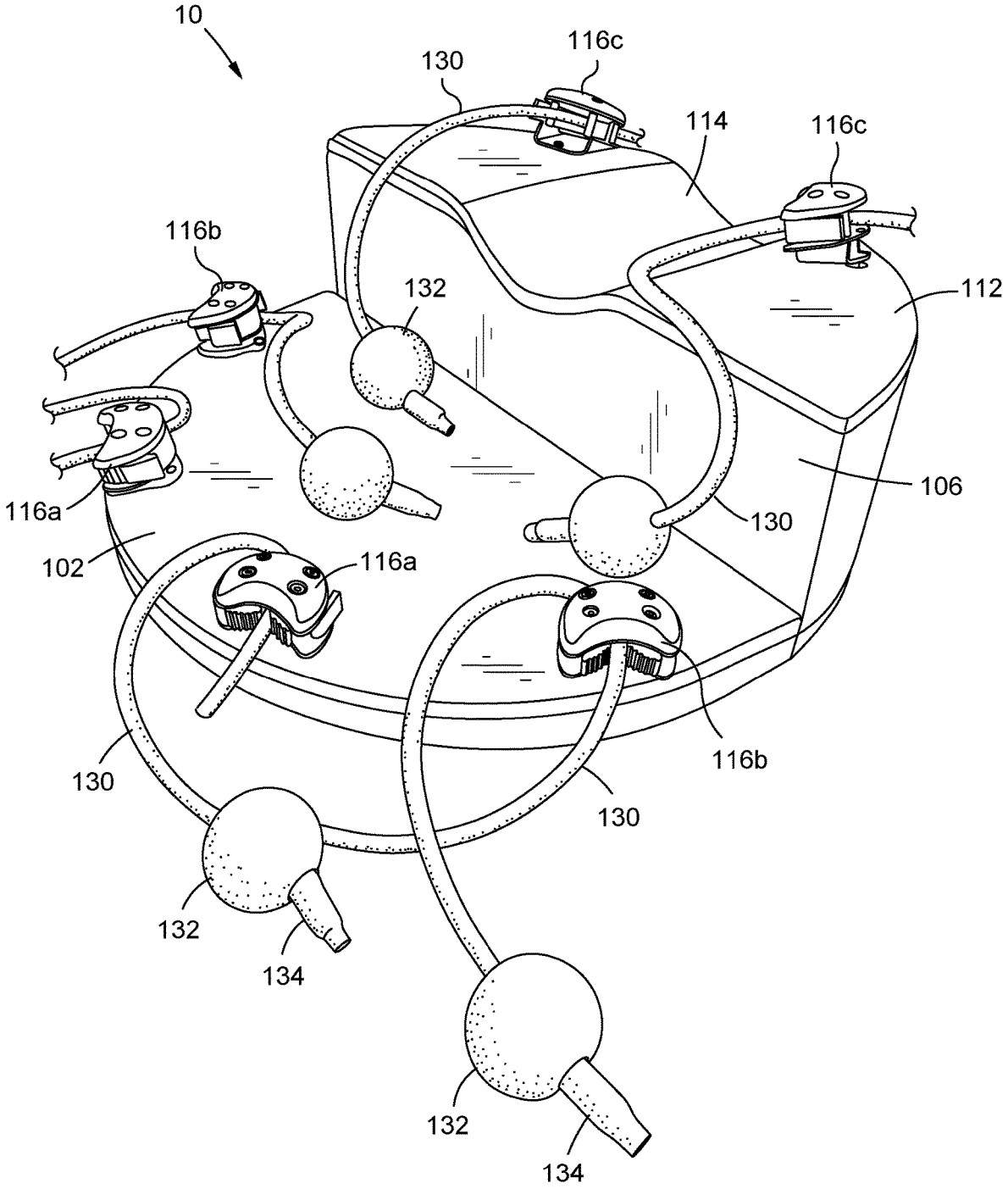
FIG. 3 is a perspective view of the ankle and foot therapy and strengthening device shown in FIG. 1 with therapeutic bands and balls attached.

FIG. 3 is a perspective view of the ankle and foot therapy and strengthening device shown in FIG. 1 with therapeutic bands and balls attached. As shown in FIG. 3, fitness bands 130 are inserted and held in place by the band adjustment and locking devices 116. The fitness bands 130 are preferably resistive, e.g. they generate a biasing force when stretched or elongated (wherein the generated rate of change in resistive force may be generally linear or non-linear based upon a change in length in the band), and may thus be constructed of latex rubber material or other elastic material. The fitness bands 130 may be tube shaped to fit and lock within the band adjustment and locking devices 116, but the bands might have other shapes such as being generally flat/planar. Multiple sets of fitness bands 130 may be used with the device 10. For example, a first set of bands providing high resistance (e.g. a high biasing/resistive force per distance of elongation) and a second set of bands providing a relatively lower resistance (e.g. a lower biasing/resistive force per distance of elongation) may be used interchangeably. For example, an approximate resistance for the high resistance heavy tubing around 12.4 Newtons, with the approximate resistance for the lower resistance tubing at approximate 4.0 N.

At least one band stop 134 is associated with each band 130. In general, the band stop 134 is designed to engage a user of the bands 130 to aid in fixing or connecting the band 130 to the user, as described in more detail below. In one embodiment, the band stop 134 abuts against a toe engaging device which is implemented here as a ball 132 which is associated with each band, preferably at or near an end of each of the bands 130 (although it is possible for a ball 132 to be located along a band 130 between its ends). The ball 132 is preferably formed from a resilient material such that is provides cushioning to the toes and foot of the user during the use of the ankle and foot therapy and strengthening device 10. The ball 132 is formed of a sufficient size and rigidity, however, that when the band 130 is placed between a user's toes, the ball 132 does not pass between the user's toes, thus effectively mounting the band 130 to the user's foot, even when the band 130 is stretched to provide resistance. The position of the ball 132 on the user's foot may be to sit on the plantar surface (under surface of the toe) or on the dorsum of the toes (top of the toes) depending on the exercise being performed. Thus, no harness or other similar device to connect the band to the foot is required. It is noted that in the place of the ball 132, other objects may be utilized as the toe engaging device, such as objects or other shapes with similar resiliency. The ball 132 facilitates exercises using the bands 130 via the ankle and foot therapy and strengthening device 10 as will be explained below. As shown here in FIG. 3, the ball 132 is generally spherical and is about the size of a golf ball, having a diameter of around 42 mm. However, the size may be larger or smaller so long as the ball 132 is sufficiently large so that it will not easily pass through the user's toes or fingers during use. For example, the size may range from 15 mm to 100 mm in diameter. More preferably, the diameter of the ball 132 may range from 35 mm to 50 mm. In other embodiments, the ball 132 might not be perfectly spherical, such as by being somewhat ellipsoid or the like. As noted below, the balls 132 are preferably sized so that they are generally too large to pass between a user's toes (or fingers or the like), and preferably define a generally smooth and rounded contact surface to the user (such as the user's foot and toes).

In one embodiment, the ball 132 defines at least one passage therethrough, whereby the ball 132 is mounted to the band 130 by the band passing through the passage. The ball 132 could be mounted to the band 130 in other manners. For example, in one embodiment, the ball 132 might comprise two hemi-spheres which may be connected to one another. The two hemi-spheres might be opened and the band 130 might be placed between them and then the hemi-spheres might be re-connected around the band 130. In another embodiment, the ball 132 may be formed in a substantially spherical shape, and the passage may be removed from the ball to facilitate passage of the band 130. In another embodiment, the ball 132 and the band 130 may be formed integrally.

As noted above, in one embodiment, a band stop 134 is preferably mounted at or near a first end or portion of the band 130 to hold the ball 132 in position near the end of the band 130. The band stop 134 may comprise, for example, a cap element which is securely mounted to the end of the band 130, This cap is preferably sized to prevent the ball 132 from passing over or along the cap and thus off of the band 130. Of course, the band stop 134 might have other configurations. For example, the band stop 134 might comprise a knot formed at or near the end of the band 130.

Figure 4:
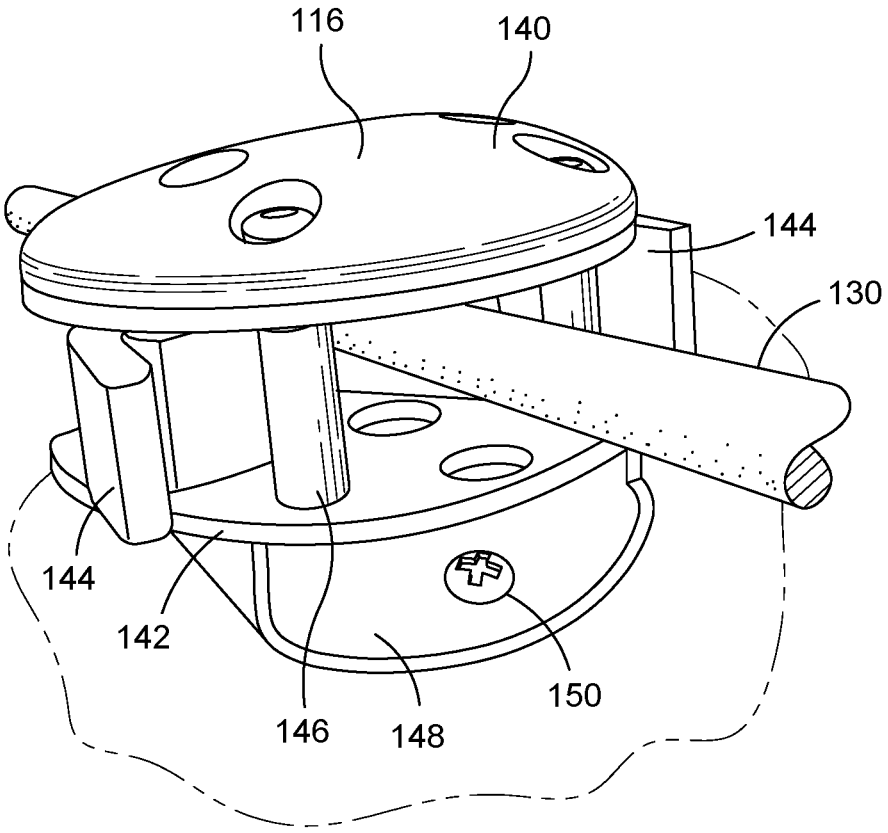
FIG. 4 is a perspective view of a band adjustment and locking device, according to one exemplary embodiment.

Preferably, the other end of the band 130 is or can be mounted to the base 100. FIG. 4 is a perspective view of one end of a band adjustment and locking device, according to one exemplary embodiment. The adjustment and locking devices 116 are preferably configured to selectively connect a first end or portion of a band 130 to the base 100, and to allow the length of the band (between the locking device 116 and the band stop) to be adjusted.

In one embodiment, the band adjustment and locking devices 116 comprise a top plate 140, a bottom plate and a pair of spacing band guides 146 therebetween. The band guides 146 support the structure of the locking device 116 and provide an opening or guide for the band 130 that is inserted therethrough. The device 116 includes two rotatable members 144 that together form a clamp around the band 130 to hold it in place. The locking devices 116 further comprises a mounting plate 148 with fasteners 150 to mount the locking devices 116 to the ankle and foot therapy and strengthening device 10.

Figure 5:
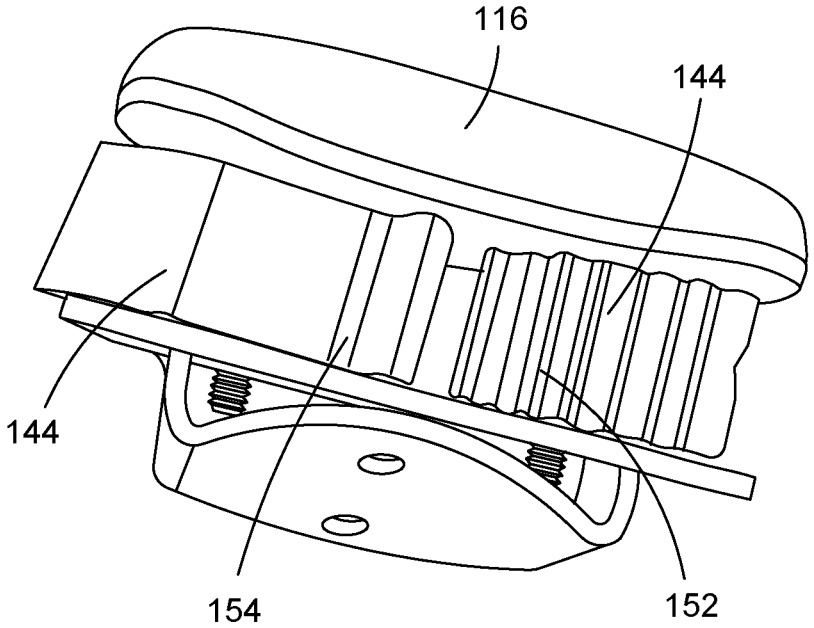
FIG. 5 is an alternate view of the band adjustment and locking device of FIG. 4.

FIG. 5 is an alternate view of the band adjustment and locking device of FIG. 4. As shown in FIG. 5, each of the rotatable members 144 include an arm 154. On an inside surface of the arm there are a plurality of angled surfaces 152. The angled surfaces 152 allow the band 130 to pass through in one direction while catching the band 130 when the band is pulled the opposite direction. When the angled surfaces catch the band 130, the arms 154 of the two rotatable members 144 are pulled towards each other, clamping the band 130 in place. In some embodiments, the rotatable member 144 may be spring loaded to aid in the clamping of the band 130. To disengage the band 130, the user rotates the arms 154 of the rotatable members away from each other to allow the band to pass through unimpeded.

Figure 6A:
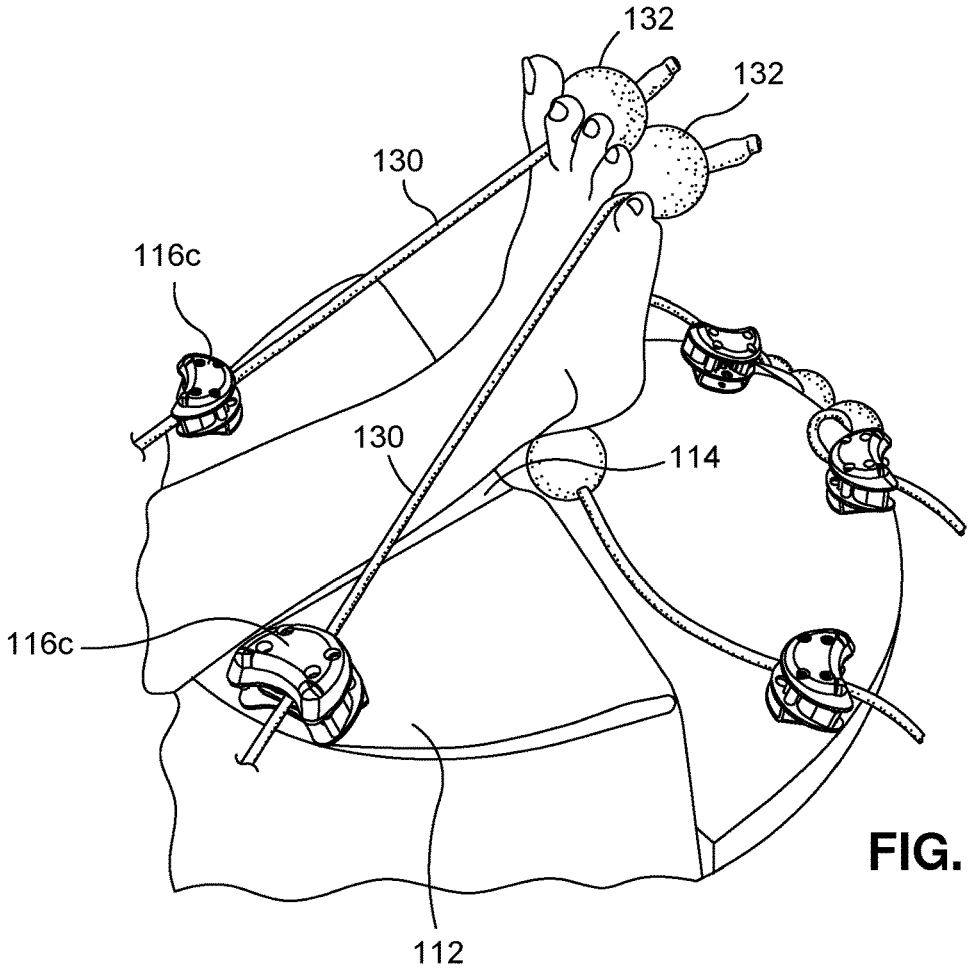
FIG. 6A and FIG. 6B show an exemplary exercise facilitated by the ankle and foot therapy and strengthening device, according to one exemplary embodiment.
Figure 6B:
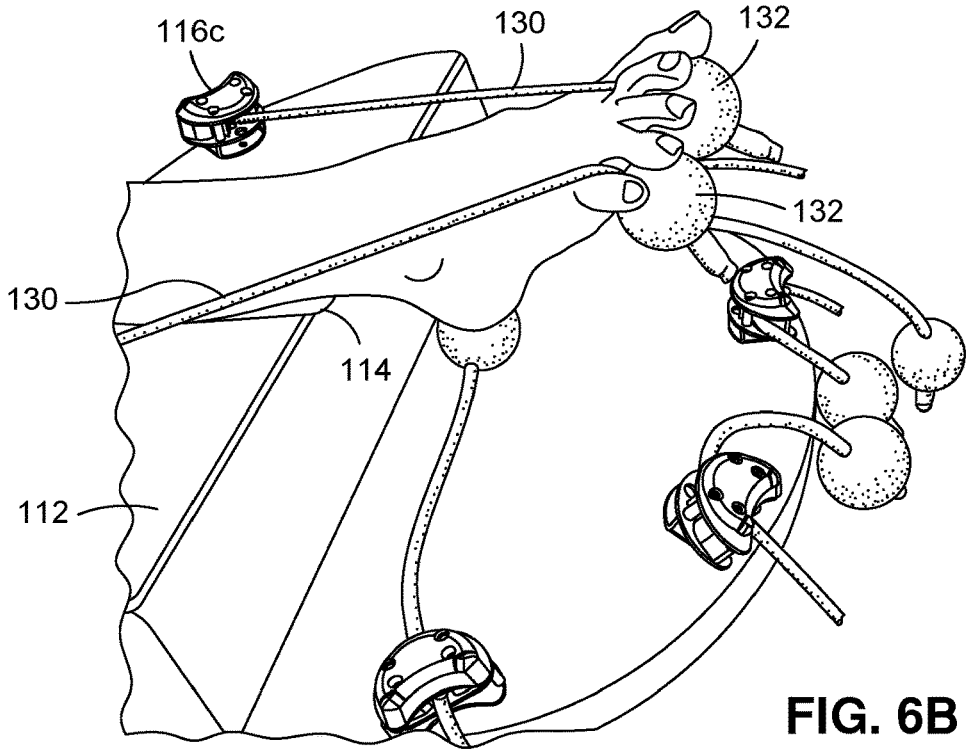

FIG. 6A and FIG. 6B show an exemplary exercise facilitated by the ankle and foot therapy and strengthening device, according to one exemplary embodiment. In this example, a plantar flexion exercise will be described. In FIG. 6A, bands 130 are inserted into the rear adjustment and locking devices 116*c* so that the bands 130 have a desired length (and thus also associated resistance). As mentioned above, different bands 130 may be used depending on the desired resistance in addition to adjusting to the desired length of the band 130. The user rests his/her foot in the groove 114, preferably so that their foot (and particularly the heel thereof), extends past the sidewall 108 of the platform 106. For example, the user places his/her heel approximate three inches from the edge of the top surface 112 of the raised platform. The user places at least one band 130 between his/her toes with the ball 132 at the bottom of the foot (wherein the ball 132 is thus located at the opposing side of the toes and foot from the end of the band which is attached to the base 100).

As noted above, because the balls 132 do not fit between (e.g. are sized so that they are generally too large to readily pass between) pairs of toes (e.g. two adjacent toes), they act as stop which transfers the resistive force of the band 130 to the user's foot. The user may then move their foot against the resistance of the bands 130 to perform ankle and lower leg strengthening exercises. It is noted that a wide variety of exercises may be performed using the device 10, such as depending upon one or more of: which direction the band is passed through the toes, which toes the band is passed through, the location of the band which is used in the exercise (as mounted to the different locking devices 116 which have different locations), the number of bands which are utilized, the applied motion (of the foot, ankle, toes, etc.), and the like.

Figure 7A:
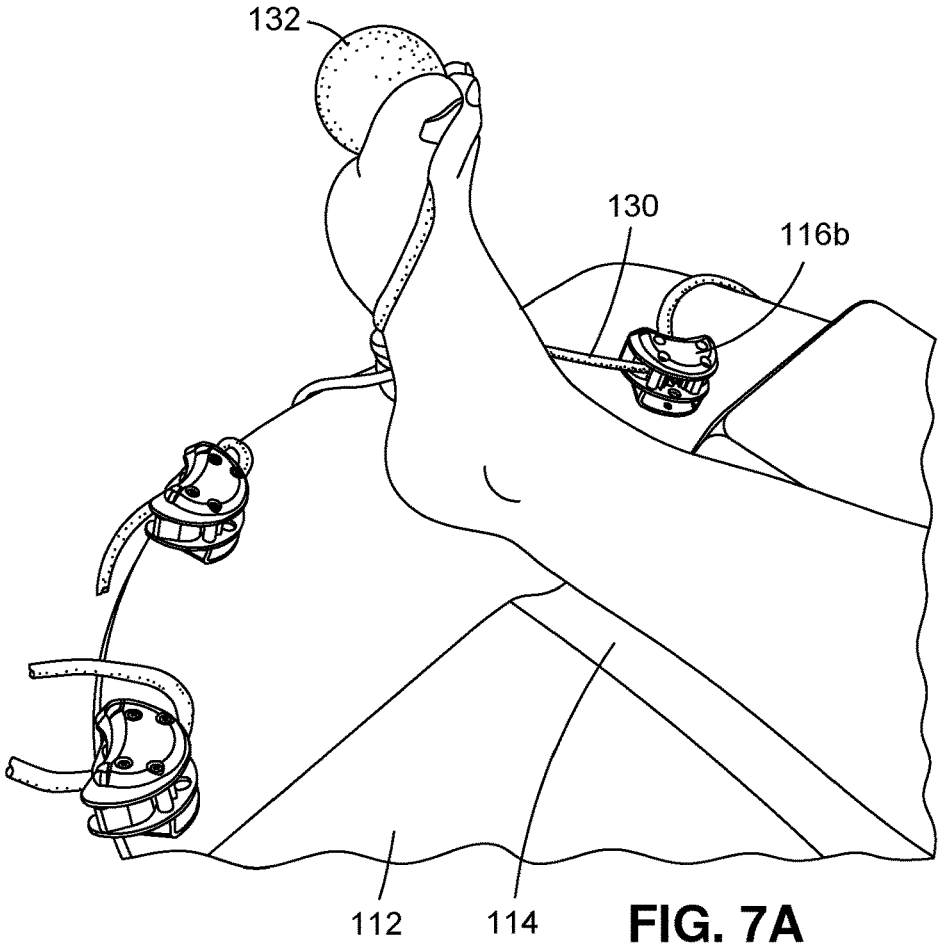
FIG. 7A and FIG. 7B show another exemplary exercise facilitated by the ankle and foot therapy and strengthening device, according to one exemplary embodiment.
Figure 7B:
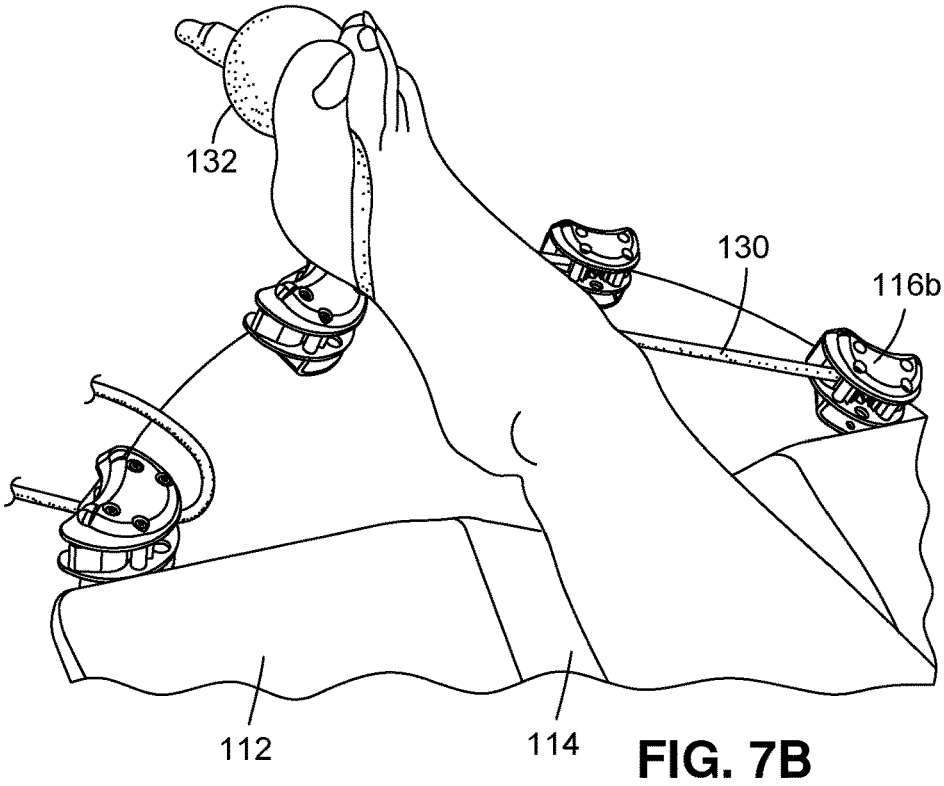

As one example, FIG. 7A and FIG. 7B show another exemplary exercise facilitated by the ankle and foot therapy and strengthening device, according to one exemplary embodiment. In this example, an ankle inversion exercise is shown. Here, a band 130 is inserted into a lateral adjustment and locking device 116*b* so that the band 130 has a desired resistance. The user rests his/her foot in the groove 114 and wraps the band 130 around the foot and between the toes. The ball 132 does not fit between the toes and thus transfers the resistance force of the band 130 to the foot. The user may then rotate the foot against the resistance of the band 130 to perform ankle and lower leg strengthening exercises.

Other types of exercises may also be completed using the device 10. For example, resistance may be applied for dorsiflexion by placing one or two balls 132 between the toes 1 & 2 and/or 3 & 4. The ball(s) 132 will rest on the dorsum of the toes. The balls 132 are attached to bands 130 connected to one or both of locking devices 116*a*.

In some instances, multiple motions may be exercised at once. For example, resistance can be applied to a plantar flexion and inversion motion. For this type of exercise, a ball 132 connected to locking device 116*b* may be placed between the first and second toes after wrapping the band 130 around the lateral side of the foot. A second ball 132 connected to a band 130 attached to locking device 116*a* may be placed between the second and third toes. The user then may activate the muscles associated with plantar flexion and ankle inversion.

The invention may have other configurations and features. For example, as described above, while in a preferred embodiment the base 100 is generally circular or cylindrical in shape, it is possible for the base to have other shapes, such as oval, square, etc.

The number of locking devices 116 and their position might vary. In one embodiment, there might be less than 6 locking devices 116, or more than 6. Also, the positions of the locking devices 116 might be changeable. Also, the shape, size and position of the raised platform 106 might vary. Preferably, however, the device 10 has at least one first portion and at least one second portion, where the at least one second portion extends above the first portion. In one embodiment, the raised platform 106 might be height adjustable, such as by being raiseable and lowerable. Alternative, the raised platform 106 might be configured from one or more stackable layers or steps which can be added onto the base 100 or one another, to change the total height of the platform 106. In another embodiment, it is possible for the base 100 to not include a raised platform 106, depending upon the range of exercises which the base 100 is intended to support.

Aspects of the invention might be used apart from the device 10 which is described above. For example, the strengthening bands 130 and associated band stops 134 and/or balls 132 might be used with other devices or in other exercises. For example, a user might orient a band 130 between two fingers of their hand with an associated ball 132 against their hand, so as to exercise their fingers, hand, wrist, etc. As another example, the bands 130 and the associated locking devices 116 might be associated with other types of bases or mounts, such as for exercising other parts of the body such as the hand/wrist.

In one embodiment, the band stops 134 and the balls 132 are mounted near the free or first ends of the bands 130. In one embodiment, the position of a ball 132 might be changed. For example, a band 130 might pass through an aperture in a ball 132. The ball 132 might include a tension lock or the like which is movable from a position which allows the band 130 to move with respect to the ball 132 (such as to change the relative positions thereof) to a locked position where the position of the ball is fixed relative to the band. In such embodiments, the band stop 134 may also be omitted, as the ball 132 may be fixed independently at any position along the band 130, including at or near an end of the band 130.

Figure 8:
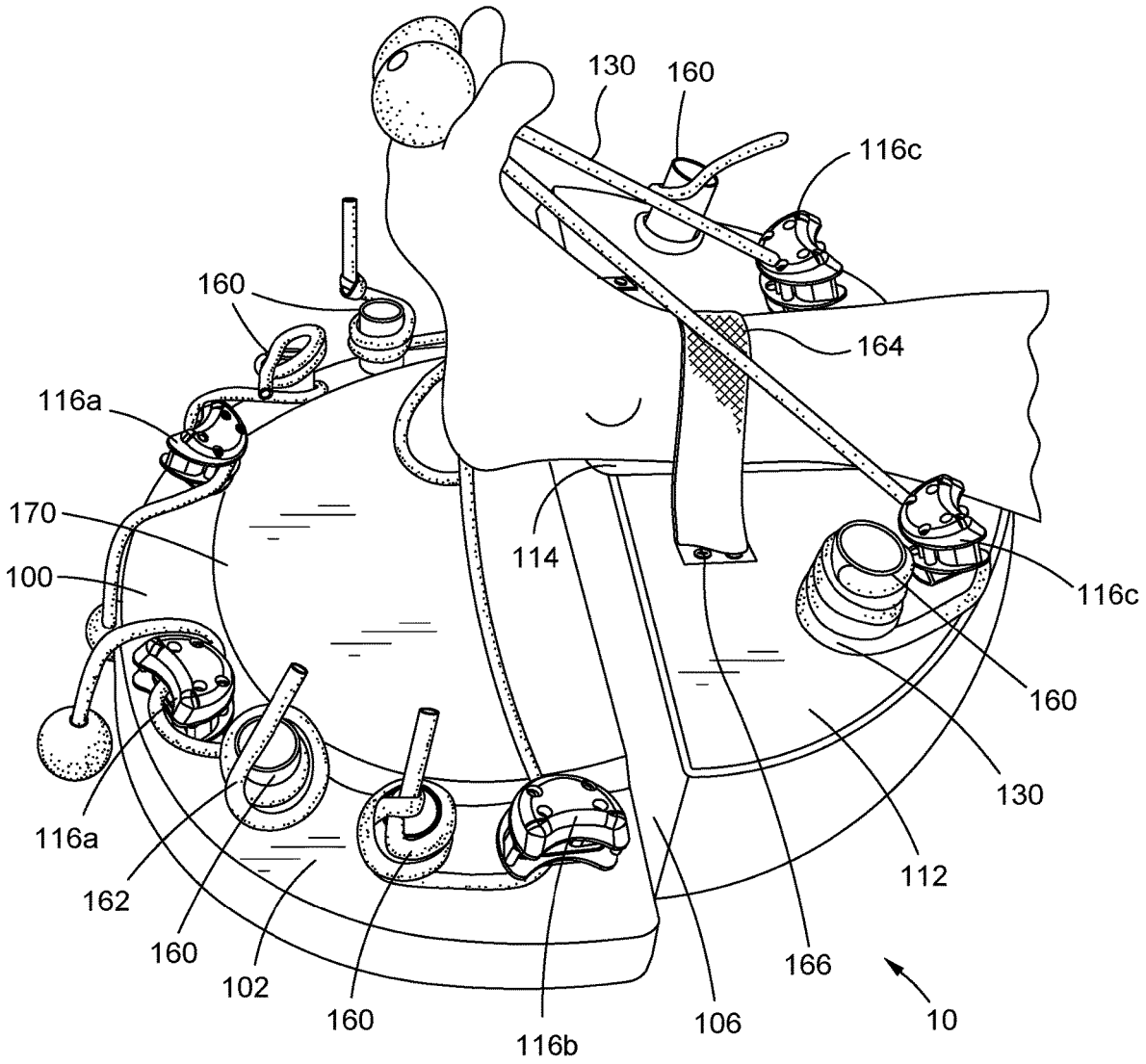
FIG. 8 shows an ankle and foot therapy device with additional accessories, according to an exemplary embodiment.

Other features may also be added to the device 10 to further enhance the usability of the device 10. FIG. 8 shows an ankle and foot therapy device with additional accessories, according to an exemplary embodiment. In this embodiment, each band adjustment and/or locking device 116 includes a corresponding band housing device 160 to hide or contain the free end of the band 130 which is connected thereto. The band housing device 160 is formed as a cylinder around which the band 130 may be wrapped to neatly store the free end of the band 130. The band housing device 160 includes a band locking notch 162 formed at the top of the band housing device 160 to lock the band 130 into the stored position.

Other devices may also be used to store the band 130 similar to the band housing device 160. For example, in one embodiment, the band housing device might include a housing having an interior. The end of the band may be located in the interior and the band may pass from that interior to the band adjustment and/or locking device 116 through the locking mechanism (rotatable arms 144 in FIG. 5). In another embodiment, the band housing device might include a retractable mechanism that automatically retracts excess band into the housing. Alternate storage systems may also be used where in a similar manner, as the length of the band 130 is adjusted (and thus the portion of the band between its free end and the locking mechanism changes), the band is hidden and/or stored by the band housing device. In another embodiment, the band housing device might be within a portion of the base 100. In yet another embodiment, the band adjustment and/or locking device, or another device, might be configured to wind or retract the band towards the base 100, such as into a stored position. The user might pull or extend the band 100 outwardly of the locking device and/or base 100 to the desired length.

The device 10 may also comprise a support strap 164 which is connected to or may be connected or mounted to the device 10, such as onto the top surface 112 of the raised platform 106. Two mounts 166 may anchor the strap 164 on each side of the groove 114. The strap 164 may be comprised of two straps each with one side of hook and loop fasteners that connect to each other when a user's leg is rest on the groove 114. The strap 164 may comprise additional padding to add comfort and support to the leg and ankle of the user. The strap 164 further serves to prevent rotation of the leg to help the user isolate the ankle to provide optimal contraction for ankle musculature.

In an exemplary embodiment, a balance pad 170 may be included with the device 10. The balance pad 170 is formed to fit on the upper surface 102 of the base 100 inside of the band adjustment and locking devices 116. The balance pad 170 is formed from a resilient material that deforms when a force is applied to the pad 170.

Figure 9:
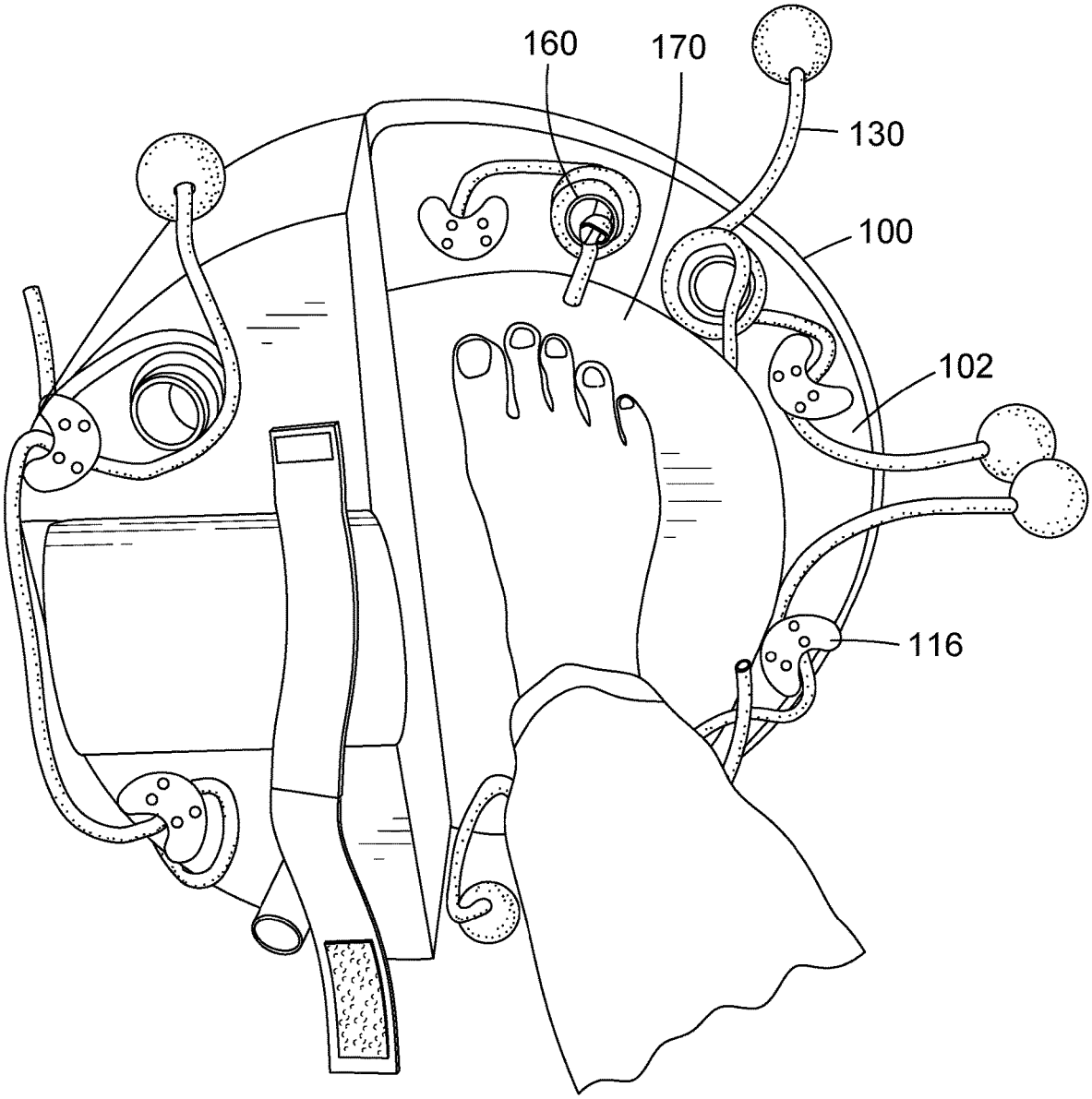
FIG. 9 shows the ankle and foot therapy device used for a balancing exercise, according to an exemplary embodiment.

FIG. 9 shows the ankle and foot therapy device used for a balancing exercise, according to an exemplary embodiment. As shown in FIG. 9 a crescent shaped balance pad 170 may be placed on the top surface 102 of the base 100. In some embodiments, the balance pad may be stored in a compartment on an underside of the base 100. The balance pad may be formed as a 2-inch cushion or pillow to facilitate a closed kinetic exercise environment to add in strengthen the foot and ankle muscle along with incorporating the CKC activity. A user balances on the balance pad 170 which is placed between the band adjustment and locking devices 116 on the top surface 102 of the base 100. The bands 130 may be kept out of the way using the band housing devices 160. The resilient nature of the balancing pad 170 increases the difficulty of the balancing exercise for the user providing better results than balancing on a hard surface. This activity is performed with a single leg balance challenge activity to improve proprioception and kinesthetic awareness. This activity adds in the overall rehabilitation on the foot ankle in a closed kinetic chain activity. To challenge one further with a single leg balance one could perform with eyes open or closed. Thus eyes closed challenges the vestibular and balance centers in the body again improving function of the foot and ankle.

Figure 10:
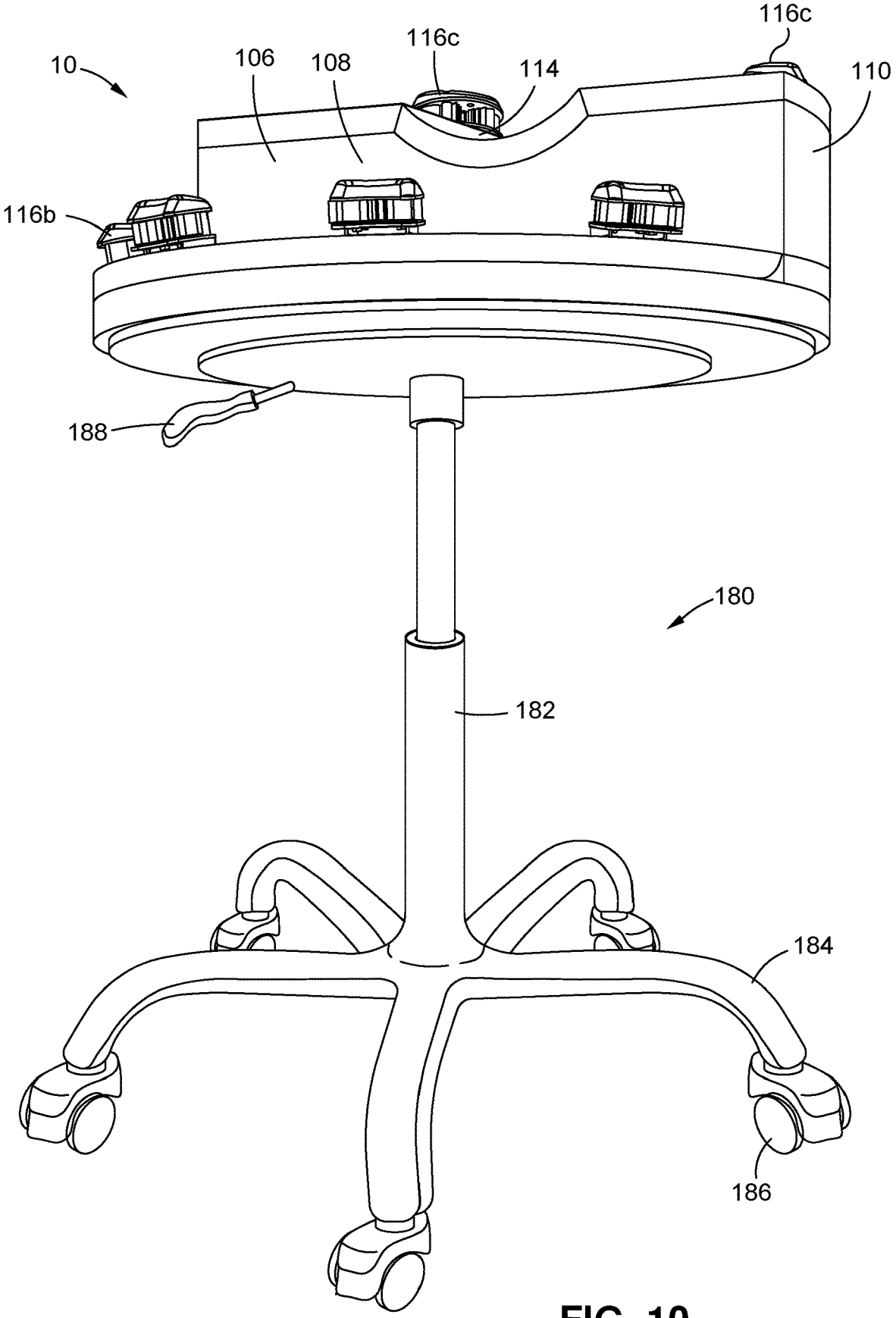
FIG. 10 shows the ankle and foot therapy device mounted on a stool, according to one exemplary embodiment.

In one embodiment, the ankle and foot therapy device 10 may be configured to be readily movable, such as by association of one or more wheels or rollers therewith, and/or may be configured to be located in a raised or elevated position for use. For example, FIG. 10 shows another embodiment of the ankle and foot therapy device. In FIG. 10, the ankle and foot therapy device 10 is mounted to a raised, wheeled, locking stand support, such as a stool 180. The stool 180 allows the device 10 to be easily transported to different locations in, for example, a physical therapy clinic. The stool 180 may comprise a height adjustable frame 182, legs 184, and casters 186. The casters 186 may be lockable. The height adjustment may be controlled by an arm 188. A physical therapist may thus use the device 10 to treat several patients at different locations in a clinic. Further, the height adjustment may allow the device to accommodate a patient sitting on a treatment table, a chair, or any other surface of different heights. The base 100 of the device 10 might be connected to a mount of the frame 182, and/or be disconnectable therefrom so as to be used independently of the support.

In some embodiments, a toe-sock (e.g. a sock having one or more individual recesses or pockets for receiving a toe apart from other toes, such as a sock having five (5) individual pockets for receiving the five (5) toes of the foot) may be provided to the user of the device 10. The toe sock may protect the skin of the user from direct rubbing against the bands 130. This also helps to prevent the spread of pathogens among different users of the device 10.

The disclosed embodiments and methods are helpful in treating a variety of conditions including but not limited to plantar fasciitis, plantarflexed inversion sprain, dorsiflexion eversion sprain, plantarflexion eversion sprain, ankle tendinitis, tendinitis, peroneus *brevis* and longus tendinosis, and other weaknesses in the foot, ankle, and lower leg. This apparatus can treat plantarflexion inversion, plantarflexion eversion, plantarflexion dorsiflexion, plantarflexion inversion/eversion dorsiflexion, and forefoot adduction and forefoot abduction. Can treat dorsiflexion and inversion weakness, dorsiflexion and eversion weakness, dorsiflexion adduction weakness, and dorsiflexion abduction weakness. It can also treat inversion plantarflexion dorsiflexion, eversion plantarflexion dorsiflexion, eversion plantarflexion adduction, inversion plantarflexion abduction. Specific explanations for using the above-described device for treating such conditions is explained in more detail in the attached appendix to the specification of the provisional patent application which is incorporated by reference herein.

In some embodiments, vibration is also built into the platform, which allows for vibration during exercise. This vibration helps to stimulate the spinal thalamic tract, which helps decrease pain by overriding the temperature and pain column. Patients at this time can also benefit from increased circulation, decreased sensitivity with vibration, help with lymphatic drainage with vibration during exercise in the platform.

The invention has numerous advantages. One advantage of the invention is a therapy device which includes a base and a raised platform, whereby a portion of the body (such as the leg) may be supported by the platform and at the same time extended off of the platform into free space, thus allowing a portion of the body (such as the ankle) to be moved in a full range of motion in free space without interference from the structure of the device. Another advantage of the invention is bands having balls, where the balls are used as stops or mounts which are placed against a portion of the user's body (such as between the toes at the bottom of the foot), to allow a user to stretch or elongate the resistive band. Such a configuration has numerous benefits over ankle collars the like, including the fact that the balls can be placed in different locations (such as between different pairs of toes), more than one band can be associated with the user's foot or other body part (such as by placing two balls between two different pairs of toes), because the user of the ball changes the location of the applied force to the user's foot or other body part (as compared, for example, to a collar which is applied to a user's ankle or around a portion of their foot).

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. An ankle and foot therapy device comprising:

a base having a top surface, the top surface comprising a first flat portion and a second flat portion, the second flat portion being a raised platform stepped up from the first flat portion, the raised platform comprising a groove formed into the raised platform that is configured to receive and support a lower leg of a user such that the foot of the user extends in a suspended position beyond the raised platform and over the first flat portion;

a first band adjustment and locking device mounted to the first flat portion;

a second band adjustment and locking device mounted to the second flat portion; and resistance bands configured to be locked into the first and second band adjustment and locking devices, the resistance bands comprising a toe engaging device attached thereto.

2. The ankle and foot therapy and strengthening device of claim 1, further comprising a strap mounted on each side of the groove to hold the lower leg within the groove.

3. The ankle and foot therapy and strengthening device of claim 1, further comprising a resilient balance pad disposed on the top surface between the band adjustment and locking devices, the resilient balance pad being a 2-inch crescent cushion pad to challenge closed kinetic activity to strengthen a foot and ankle of the user in the area of kinesthetic awareness and proprioception.

4. The ankle and foot therapy and strengthening device of claim 1, wherein the toe engaging device is a resilient ball.

5. The ankle and foot therapy and strengthening device of claim 1, further comprising a band storage device corresponding to each of the band adjustment and locking devices, each band storage device being disposed on the top surface and being configured to store at least a portion of one of the one or more resistance bands disposed on a side of the corresponding band adjustment and locking device.

6. An ankle and foot therapy device comprising:

a generally cylindrical base defining a first platform and a second platform, said first platform having a front and a rear, said second platform raised above said first platform, said second platform having a front and a rear, a wall extending downwardly from said front of said second platform to said rear of said first platform, the second platform comprising a groove formed into the second platform from said front to said rear of said second platform that is configured to receive and support a lower leg of a user such that the foot of the user extends beyond the second platform and the wall to a point elevated over said first platform;

at least one first band adjustment and locking device mounted to the second platform at said rear thereof;

at least one second band adjustment and locking device mounted to the first platform at said front thereof; and resistance bands configured to be locked into the at least one first and second band adjustment and locking devices, the resistance bands comprising a toe engaging device attached thereto.

7. The ankle and foot therapy device of claim 6, wherein the toe engaging device is a resilient ball.

8. The ankle and foot therapy device of claim 7, wherein each resistance band has a proximal end for connection to said band adjustment and locking device and a distal end, said resilient ball located at said distal end.

9. The ankle and foot therapy device of claim 6, further comprising a strap mounted on each side of the groove to hold the lower leg within the groove.

10. The ankle and foot therapy device of claim 6, wherein said at least one first band adjustment and locking device mounting to the second platform at the rear thereof comprises at least a first band adjustment and locking device located to a first side of said groove and at least a second band adjustment and locking device located to a second side of said groove.

11. The ankle and foot therapy device of claim 6, wherein said wall is generally vertically extending.

12. The ankle and foot therapy device of claim 6, further comprising a band storage device corresponding to each of the band adjustment and locking devices, each band storage device being disposed on a top surface and being configured to store at least a portion of one of the one or more resistance bands disposed on a side of the corresponding band adjustment and locking device.

13. An ankle and foot therapy device comprising:

a base having a bottom and a top, said top defining a raised platform, said raised platform having a front and a rear, a wall extending downwardly from said raised platform at said front and said rear, a groove formed in the raised platform that extends from said front to said rear and that is configured to receive and support a lower leg of a user such that the leg is suspended on said raised platform with a foot of the user extending in an elevated position beyond the raised platform past said front thereof;

at least two band adjustment and locking devices mounted to said base, at least one of said band adjustment and locking devices connected to said base at a location below said raised platform and an elevation of said user's leg; and at least one resistance band configured to be locked into the at least two band adjustment and locking devices, the at least one resistance band comprising a toe engaging device attached thereto.

14. The ankle and foot therapy device of claim 13, wherein the toe engaging device is a resilient ball.

15. The ankle and foot therapy device of claim 13, wherein the toe engaging device is a resilient ball.

16. The ankle and foot therapy device of claim 13, further comprising a strap mounted on each side of the groove to hold the lower leg within the groove.

17. The ankle and foot therapy device of claim 13, wherein said at least one first band adjustment and locking device mounting to the second platform at the rear thereof comprises at least a first band adjustment and locking device located to a first side of said groove and at least a second band adjustment and locking device located to a second side of said groove.

18. The ankle and foot therapy device of claim 13, wherein said wall is generally vertically extending.

19. The ankle and foot therapy device of claim 13, further comprising a band storage device corresponding to each of the band adjustment and locking devices, each band storage device being disposed on the top and being configured to store at least a portion of one of the one or more resistance bands disposed on a side of the corresponding band adjustment and locking device.

* * * * *